US006976272B2

(12) United States Patent
Krzysik, Jr. et al.

(10) Patent No.: US 6,976,272 B2
(45) Date of Patent: Dec. 20, 2005

(54) UNIVERSAL VISUAL SHIELD APPARATUS FOR USE WITH A HOCKEY HELMET

(75) Inventors: Edward Krzysik, Jr., South Lyon, MI (US); John DeMartino, Rochester Hills, MI (US)

(73) Assignee: I² Innovative Ideas, South Lyon, MI (US)

( * ) Notice: Subject to any disclaimer, the term of this patent is extended or adjusted under 35 U.S.C. 154(b) by 59 days.

(21) Appl. No.: 10/778,700

(22) Filed: Feb. 16, 2004

(65) Prior Publication Data

US 2005/0015839 A1 Jan. 27, 2005

Related U.S. Application Data

(60) Provisional application No. 60/472,957, filed on Jul. 9, 2003.

(51) Int. Cl.[7] ..... A42B 1/00

(52) U.S. Cl. ..... 2/9; 2/15; 473/210; 473/422; 473/450

(58) Field of Search ..... 2/425, 422, 424, 2/9, 10, 12, 15; 473/446, 450, 458, 464, 422, 473/210

(56) References Cited

U.S. PATENT DOCUMENTS 413,424 A * 10/1889 Weber ..... 2/10
1,585,023 A * 5/1926 Fant ..... 2/13
2,721,322 A * 10/1955 Harper ..... 2/12
3,041,623 A * 7/1962 Glahe ..... 2/9
3,167,783 A * 2/1965 Wolfe ..... 2/9
3,729,745 A * 5/1973 Latina ..... 2/9
3,732,574 A * 5/1973 Hale ..... 2/9
3,878,563 A * 4/1975 Pulju ..... 2/9
3,984,875 A * 10/1976 Farquharson ..... 2/10
4,021,858 A * 5/1977 Neeld et al. ..... 2/9
4,022,466 A 5/1977 Kaiser
4,031,564 A 6/1977 Wood
4,392,650 A * 7/1983 Hilton ..... 473/464
4,653,753 A 3/1987 Scarry
4,736,466 A * 4/1988 Kallstrom ..... 2/9
5,113,529 A * 5/1992 Carr ..... 2/13
5,123,116 A * 6/1992 Roth ..... 2/15
5,216,758 A * 6/1993 Rabquer ..... 2/424
5,394,564 A * 3/1995 Rodriguez ..... 2/9
5,406,645 A * 4/1995 Lin ..... 2/10
5,699,556 A * 12/1997 Chen ..... 2/9
6,174,248 B1 1/2001 Lawlor et al.
6,272,690 B1 * 8/2001 Carey et al. ..... 2/206

* cited by examiner

*Primary Examiner*—Rodney M. Lindsey
(74) *Attorney, Agent, or Firm*—Carrier, Blackman & Associates, P.C.; Joseph P. Carrier; William D. Blackman

(57) ABSTRACT

A universal visual shield apparatus, for use with a hockey helmet, is usable for training hockey players by partially blocking a user's field of vision. The apparatus includes a main shield body formed from an elastically deformable material, and is attachable to the helmet using connectors. The main shield body includes a horizontal floor portion and a vertical edge portion that cooperate to block a user from seeing the puck while it is in the user's possession, while still allowing the user to see forward. When worn, the apparatus forces the user to look forward, beyond the puck and stick. The apparatus may include adjustable apparatus straps, and can be used on any sized helmet without modifying the helmet or the apparatus. Because the apparatus is soft and crushable, the apparatus will not harm the user or another player if they are involved in a collision on the ice.

20 Claims, 4 Drawing Sheets

FIG - 4
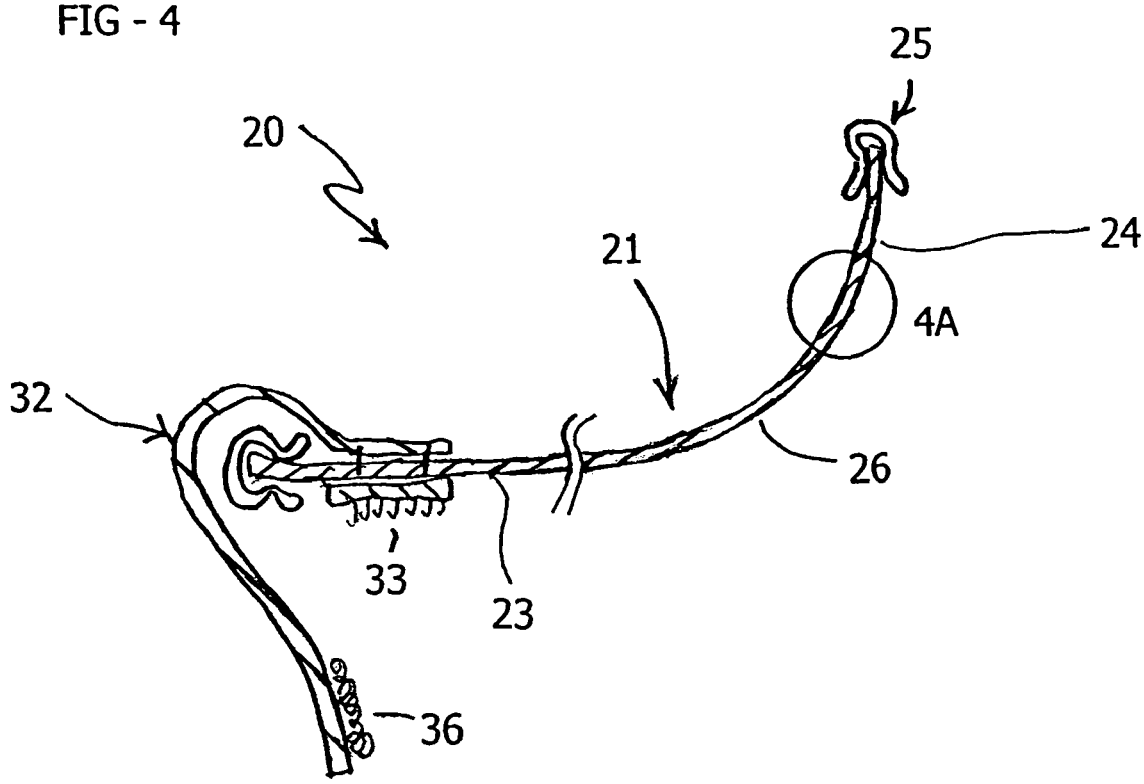
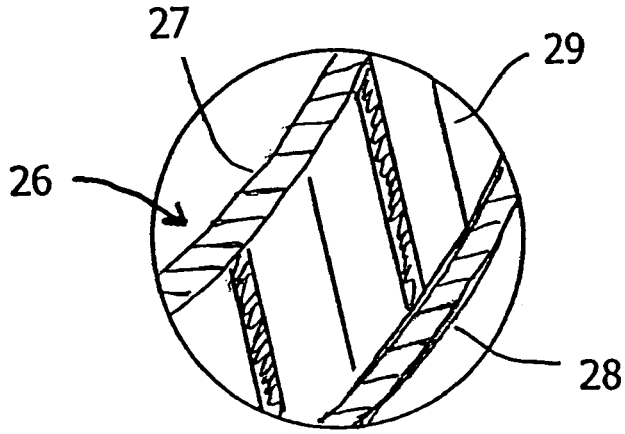
FIG - 4A

UNIVERSAL VISUAL SHIELD APPARATUS FOR USE WITH A HOCKEY HELMET

CROSS-REFERENCE TO RELATED APPLICATIONS

The present application claims priority under 35 U.S.C. 119(e), based on U.S. provisional patent application Ser. No. 60/472,957, filed Jul. 9, 2003.

BACKGROUND OF THE INVENTION

1. Field of the Invention

The present invention relates to sports training equipment. More particularly, the present invention relates to a universal visual shield apparatus for attaching to a hockey helmet, for limiting the field of view of a user thereof, and for teaching hockey players to skate while looking forward, instead of downwardly.

2. Description of the Background Art

The game of ice hockey involves the use of a hard rubber puck, and a wooden or composite stick, with a handle for gripping and a blade for directing the puck along the ice surface. A player uses the stick to maneuver the puck around the ice, to avoid other players on the opposing team, and to pass the puck to friendly players.

Beginner ice hockey players are faced with a difficult challenge. They quickly learn that it is difficult to retain control of the puck while they are attempting to skate with it. Usually, beginner players are also learning how to skate, so the challenge is intensified. Players often cannot resist looking down at the ice, either to watch their skating and/or to focus on the puck.

Beginner hockey players are also usually required to wear a helmet with a full facemask to protect themselves from injury from flying pucks, sticks, collisions with other players, or with other objects that may be in the playing arena.

A number of different devices are known for teaching hockey players to develop and improve their hockey playing ability. Examples of some of the known devices include those disclosed in U.S. Pat. No. 4,022,466, U.S. Pat. No. 6,174,248, and U.S. Pat. No. 4,653,753.

U.S. Pat. No. 4,022,466 to Kaiser discloses a vision-restricting accessory for attaching to a hockey helmet. The apparatus of Kaiser limits a user's downward vision for the purposes of improving stick handling and teaching the user to skate with the puck without focusing on it. The apparatus of Kaiser includes a flat, horizontal plate having curved edges, dimensioned to approximate a user's helmet, and a pair of vertical shafts that couple the flat curved section to the helmet. The vertical shafts are connected to the helmet using mounting hardware, and are tightened in place using thumbscrews.

Although Kaiser discloses a hockey helmet apparatus for limiting downward vision, problems still exist with the disclosed apparatus. In particular, the horizontal plate of Kaiser has no vertical component, so the vision of the user is not as limited as possible, therefore decreasing the training effect of the invention. Also, the apparatus of Kaiser requires modification of the hockey helmet, to attach mounting hardware thereto for supporting the plate.

Further, the invention of Kaiser is not adaptable to work with the variety of face masks or masks which are common today, and which are required for novice players, the likely users of the invention. The apparatus of Kaiser further must be made in a size to conform to the size of the helmet which it is being used on.

U.S. Pat. No. 6,174,248 to Lawlor et al discloses a hockey stick training device which attaches to the shaft of a hockey stick above the blade. The device consists of a clamping means and a horizontal plane that limits the player's view of a puck while it is being carried along the ice by the player. The purpose of the device is to train the player to learn the feel and touch of the puck on the stick without actually seeing it, to improve puck handling and passing/shooting skills.

Although Lawlor et al does disclose a useful device, it does have some drawbacks. Firstly, the player's vision is not limited except for the small area covered by the horizontal plane member directly below, on the stick blade. A novice player will still want to focus on the plane member, knowing that the puck is underneath. As a result, the player is still keeping his focus down and straight ahead, and is not learning to skate looking forward and around, to avoid a collision. Secondly, the device is not functional if the player does not have possession of the puck. If a player is skating without the puck, he is still able to look down, and still may be likely to have a collision.

U.S. Pat. No. 4,653,753 to Scarry discloses a hockey stick training device similar to Lawlor et al., above. A horizontal plate is secured to a hockey stick above the blade, so as to shield the puck from the player's vision, at least while he has possession of the puck. Scarry recognizes the danger posed to players who focus on the ice below and in front of them, and essentially stare at the puck. However, like Lawlor above, his invention is useful only when the player possesses the puck. As it is common for a player to skate and maneuver around the ice without the puck, the risk of collision is greater than if the player does possess the puck and all the other players are focused on the puck-holding player.

Although the known devices have some utility for their intended purposes, a need still exists in the art for an improved visual shield apparatus for use with a hockey helmet. In particular, there is a need for a visual shield apparatus that is constructed of a durable yet soft and resiliently deformable material, and that fits virtually all sizes of hockey helmets without requiring modification of the helmet.

SUMMARY OF THE INVENTION

The present invention provides a universal visual shield apparatus, for use with a hockey helmet to limit the field of view of a user. When installed in an operative position on a hockey helmet, the shield apparatus hereof blocks the user's view of his stick and puck, while still allowing the user to see forward. The visual shield hereof trains the player to use his peripheral vision and sense of touch to retain possession of the puck on his or her hockey stick.

It is an object of the present invention to provide an apparatus which, when used, will deter the undesirable behavior of skating with the head pointed down, staring at the puck. This behavior leaves the player open to dangerous collisions, especially since the player likely would have no prior warning of an impending collision.

The present invention provides a universal visual shield apparatus that quickly and easily attaches to all sizes of hockey helmets with facemasks. The apparatus features a substantially horizontal floor portion and a substantially vertical edge portion operatively attached to the floor portion.

In use, the apparatus hereof is arranged so that a player wearing the apparatus cannot see a hockey puck that may be on his stick, forcing him to learn by feel whether the puck is there or not.

The apparatus according to the present invention also allows a user to quickly remove the apparatus for periods when the player is not practicing puck handling, or other times when wearing the apparatus is not desired or appropriate. Conversely, the apparatus allows for quick and easy installation by way of a strap at either end of the curved apparatus, at the trailing edges of the facemask and at the bottom of the shield below the chin of the user.

Further, the present invention is constructed of durable materials, yet is washable and stain and odor resistant. Hockey equipment, including helmets, are subjected to rough treatment, and the present invention is designed to be durable, yet also safe; in the event of a collision, the apparatus will deform and not present a hard object that could injure the user or others.

The present invention also is adaptable to all sizes and types of hockey helmets. The apparatus straps are adjustable to as to engage with the wide variety of helmets available. Since adults are also taking up ice hockey, the apparatus according to the present invention also can be used on larger helmet sizes without requiring modification thereof.

Once the player has developed the skills required to play hockey without looking down and watching the puck, the apparatus may be removed, without adversely affecting the hockey helmet.

Accordingly, it is an object of the present invention to provide an apparatus, for use with a hockey helmet, that teaches and educates beginner hockey players to avoid watching the puck as they attempt to skate with the puck.

It is another object of the present invention to develop beginner hockey players' peripheral vision by overcoming the instinctive desire to watch the puck instead of the player's surroundings.

It is another object of the present invention to reduce the likelihood of dangerous collisions between players, particularly beginner players, due to their inability to see obstacles as a result of their focusing on skating with the puck.

It is yet another object of the present invention to train beginner hockey players to develop a feel for having the puck on their sticks, and the instincts to know where the puck is without actually looking down at the puck for verification. Players will develop a feel for having the puck on their sticks based on peripheral vision and vibrations carried up the stick shaft from puck/stick blade contact.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4 is a cross-sectional view of the shield apparatus, taken along the line 4—4 in FIG. 3;

FIG. 4A is a detail view of a portion of the shield apparatus of FIG. 4.

DETAILED DESCRIPTION

Figure 1:
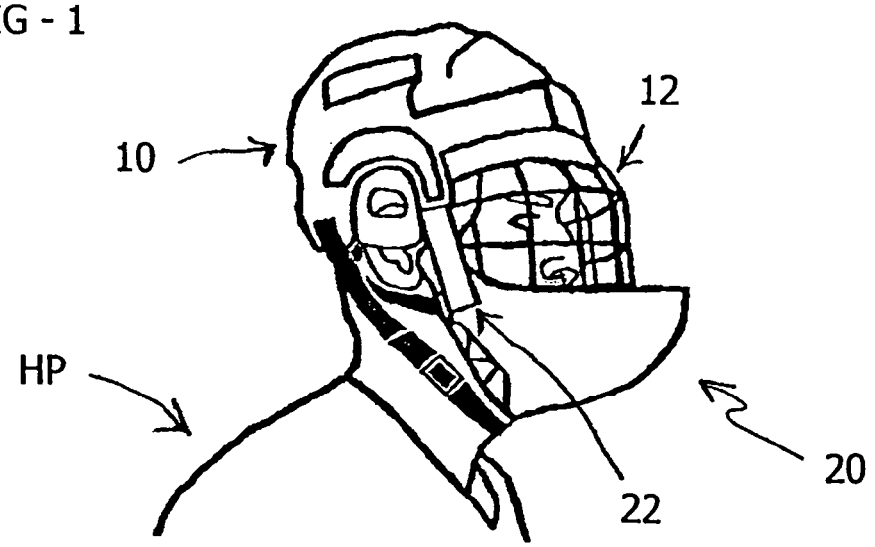
FIG. 1 is side profile view of a hockey player wearing a helmet with a visual shield apparatus according to an illustrative embodiment of the present invention installed thereon.

Referring now to FIG. 1, a hockey player HP is seen wearing a hockey helmet 10 with a universal visual shield apparatus 20 installed thereon, and in an operational configuration thereof. The universal visual shield apparatus 20 is attachable to hockey helmets 10 of virtually any size, without requiring any modification of the helmet or the apparatus. The universal visual shield apparatus 20 is connectable to the "cage" or face mask 12 of the helmet 10 via connectors 22.

Figure 3:
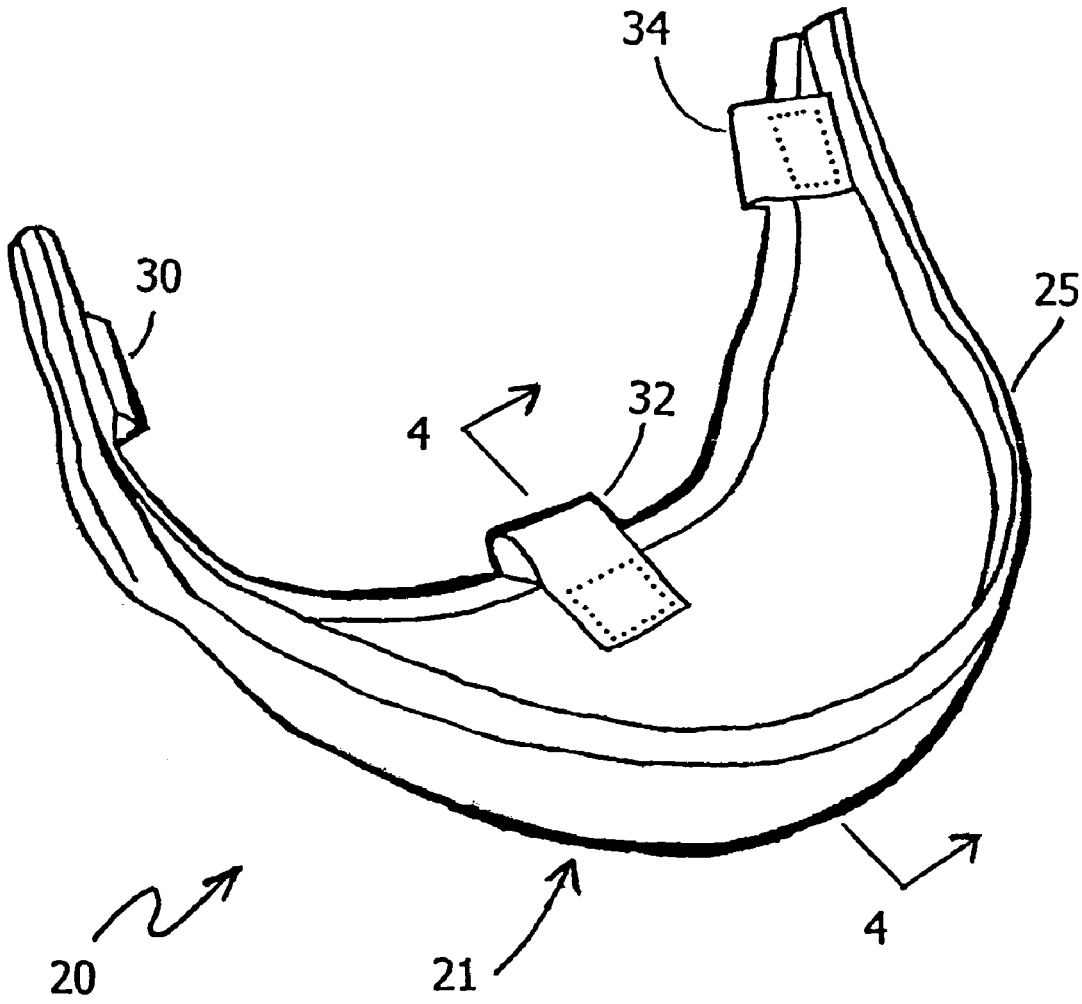
FIG. 3 is a perspective view of the universal visual shield apparatus of FIGS. 1–2, in an operative configuration thereof.
Figure 5:
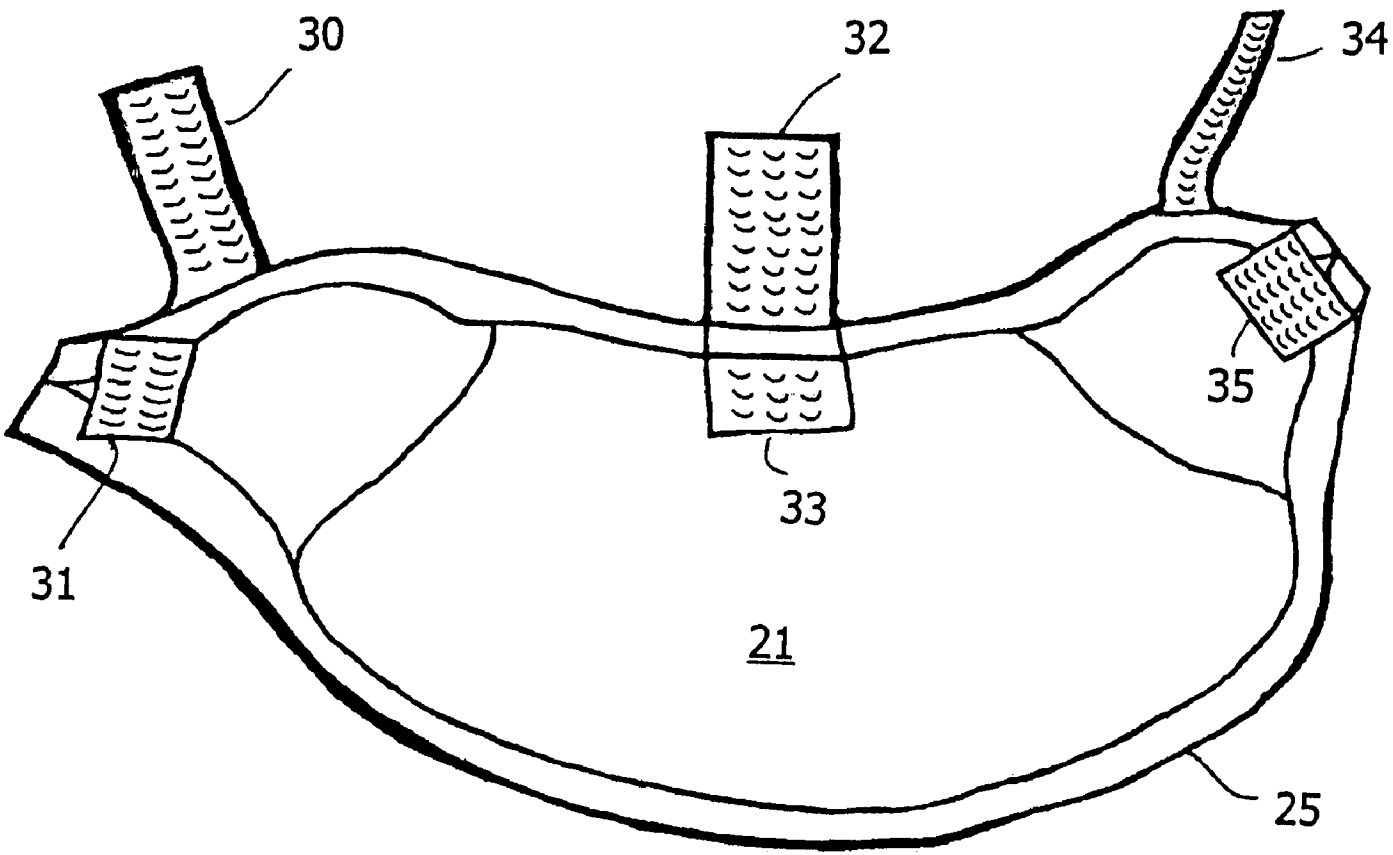
FIG. 5 is a top plan view of the universal visual shield apparatus of FIG. 3, showing the connecting straps in a detached configuration thereof.

Referring now to FIGS. 3–5, it will be seen that the universal visual shield apparatus 20 includes a main shield body 21, and a plurality of connectors 22 attached to the main shield body. As seen best in FIG. 4, in the operative configuration of the depicted embodiment, the main shield body 21 includes a substantially horizontal floor portion 23 and a substantially vertical outer edge portion 24.

The main shield body 21 has a substantially crescent-shaped outline, with two narrow ends and a wide central portion. The main shield body includes a panel member 26 formed from an elastically deformable opaque material. As seen in the detail view of FIG. 4A, the panel member 26 may be made from two outer layers of stretchable fabric 27, 28 with a resiliently and elastically stretchable rubber or elastomeric inner layer 29 sandwiched between, and joined to the fabric layers. Alternatively, the panel member 26 may be made from a felted cloth material.

The panel member 26 is made from a generally soft and elastically deformable material, as noted, so that in the event of a collision between players, the visual shield apparatus 20 will be flexibly compressed, and will not injure either the wearer HP or the other player. The elastically deformable and flexibly compressible nature of the panel member 26 also permits a user to store the apparatus 20 loosely in an equipment bag, without fear of damaging either the apparatus or other items in the bag.

In the depicted embodiment, the main shield body 21 also includes a fabric binding 25, attached to and surrounding the outer periphery of the panel member 26. The fabric binding may also include an elastic material.

As previously noted, the visual shield apparatus at least two connectors 22 attached to the main shield body 21. In the depicted embodiment, the connectors 22 are provided in the form of three flexible connecting straps 30, 32, 34. The straps 30, 32, 34 are usable to fasten the shield apparatus 20 to the hockey helmet 10, in the operational configuration thereof shown in FIGS. 1 and 2. When the helmet 10 and attached shield apparatus 20 is worn by a user HP, the shield apparatus 20 extends outwardly from the helmet to partially block the lower field of vision of the user.

Each of the straps 30, 32, 34 has a first fastener thereon, which may be a loop portion of a hook and loop fastener, as shown at 36 in FIG. 4.

As seen in FIG. 5, the apparatus 20 also includes a respective second fastener 31, 33, 35 attached to the main shield body 21, for each of the straps 30, 32, 34. The second fastener may be a hook portion of a hook and loop fastener, as shown at 33 in FIG. 4. Those in the art will realize that other fastening combinations, such as stretch bands and attachment posts, snaps, or other fasteners may be substituted for the hook and loop fasteners shown in the drawings.

The first and second fasteners of each strap (for example, 36 and 33 in FIG. 4) are detachably connectable to one another, so that each strap may be wrapped around a portion of a hockey helmet 10 and fastened back on to the main shield body 21 to form a loop.

Figure 2:
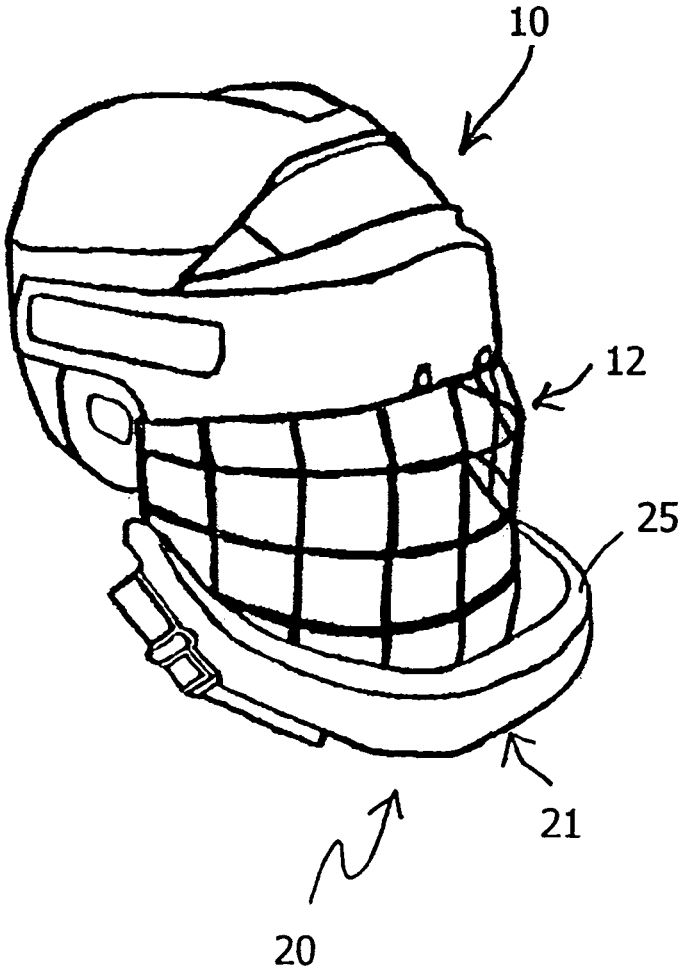
FIG. 2 is a perspective view of the hockey helmet and universal visual shield apparatus of FIG. 1.

When attached to a hockey helmet 10 in the operative configuration thereof, as shown in FIGS. 1–2, in use, the visual shield apparatus 20 blocks the user's view of his or her hockey stick, and forces the user to look forward instead of downwardly, helping train the user to handle the puck primarily by feel, rather than vision.

The universal visual shield apparatus 20 is usable on any one of a plurality of different-sized helmets, without requiring modification of the helmet or of the apparatus. This is made possible because of the flexible nature of the shield apparatus 20, and because of the adaptability of the connectors 22, which wrap around the face mask 12 and fasten back on to the main shield body 21 to fasten the apparatus 20 to the helmet 10.

Although the present invention has been described herein with respect to a limited number of presently contemplated embodiments, the foregoing description is intended to be illustrative, and not restrictive. Those skilled in the art will realize that many modifications of the preferred embodiment could be made which would be operable. All such modifications, which are within the scope of the present disclosure including equivalents of the disclosed structures, are intended to be within the scope and spirit of the present invention.

Having, thus, described the invention, what is claimed is:

1. A universal visual shield apparatus for use with a hockey helmet, said shield apparatus comprising:

a main shield body attachable to said hockey helmet in an operational configuration, said main shield body comprising panel member formed from an elastically deformable opaque material comprising a fabric; and at least two connectors attached to said shield body, each of said connectors being usable to fasten the shield apparatus to the hockey helmet in the operational configuration, wherein the apparatus is configured such that when it is attached to a helmet in the operational configuration and the helmet is worn by a user, the shield apparatus extends outwardly from the helmet below a chin of the user to partially block the field of view of the user, while still allowing lateral peripheral vision of the user, wherein the apparatus is usable on any one of a plurality of different-sized helmets, without requiring modification of the helmet or of the apparatus.

2. The universal visual shield apparatus of claim 1, wherein each of the connectors comprises a strap having a first fastener thereon;

and wherein the apparatus further comprises a respective second fastener, attached to the main shield body, for each of said straps;

said first and second fasteners of each strap being detachably connectable to one another, whereby each strap may be wrapped around a portion of said hockey helmet and fastened back on to said shield body to form a loop.

3. The universal visual shield apparatus of claim 2, wherein said first fastener comprises a first part of a hook and loop fastener, and wherein said second fastener comprises a second part of a hook and loop fastener.

4. The universal visual shield apparatus of claim 3, wherein said apparatus comprises a fabric binding attached to and surrounding the outer periphery of said main shield body.

5. The universal visual shield apparatus of claim 1, wherein in the operational configuration thereof, said apparatus comprises a substantially horizontal floor portion, and a substantially vertical edge portion operatively connected to said floor portion.

6. The universal visual shield apparatus of claim 1, wherein said main shield body comprises a flexibly stretchable elastic material for minimizing harm to the user or to another player if the user becomes involved in a collision while wearing the apparatus.

7. The universal visual shield apparatus of claim 6, wherein said main shield body comprises neoprene.

8. The universal visual shield apparatus of claim 6, wherein said apparatus comprises a fabric binding attached to and surrounding the outer periphery of said panel member, and wherein said binding comprises a flexibly stretchable elastic material.

9. The universal visual shield apparatus of claim 1, wherein the main shield body forms a substantially crescent-shaped outline in the operational configuration of the apparatus, and the crescent shaped outline includes a wide central portion and two narrow ends.

10. A universal visual shield apparatus for use with a hockey helmet, comprising:

a main shield body attachable to said hockey helmet in an operational configuration, said main shield body comprising a panel member having a substantially crescent-shaped outline in the operational configuration thereof and being formed from an opaque, elastically stretchable material comprising a fabric; and at least two straps connected to said main shield body, each of said straps usable to fasten the shield apparatus to said hockey helmet in such a manner that when the helmet is worn by a user with the apparatus attached thereto in said operational configuration, the shield apparatus extends outwardly from an area of the helmet beneath the nose of the user to partially block the field of view of the user, while still allowing lateral peripheral vision of the user.

11. The universal visual shield apparatus of claim 10, wherein each of the straps comprises a first fastener thereon, and wherein the apparatus further comprises a second fastener, attached to the main shield body, for each of said straps, said first and second fasteners being detachably connectable to one another, whereby each strap is adapted to be wrapped around a portion of said hockey helmet and fastened to said main shield body to form a loop.

12. The universal visual shield apparatus of claim 10, wherein in the operational configuration thereof, said apparatus comprises a substantially horizontal floor portion, and a substantially vertical edge portion operatively connected to said floor portion.

13. The universal visual shield apparatus of claim 10, wherein said apparatus comprises a fabric binding surrounding the outer periphery of said panel member, and wherein said binding comprises a stretchably flexible elastic material.

14. The universal visual shield apparatus of claim 10, wherein the panel member of the main shield body comprises neoprene.

15. A hockey helmet kit for use in training a hockey player, said hockey helmet kit comprising:

a helmet having a face mask;

a universal visual shield comprising a main shield body and a pair of connectors attached to the main shield body for connecting the universal shield to the face mask; wherein the universal visual shield is attachable to said hockey helmet in an operational configuration such that when the helmet is worn by the player, the universal visual shield extends outwardly from the helmet to partially block a field of view of the player, while still allowing lateral peripheral vision of the player.

16. The hockey helmet kit of claim 15, wherein the main shield body comprises a panel member comprising plural layers of stretchable fabric and at least one elastomeric layer sandwiched between and joined to the plural layers of the stretchable fabric.

17. The hockey helmet kit of claim 16, wherein the elastomeric layer includes a resilient and elastically stretchable rubber.

18. The hockey helmet kit of claim of claim 15, wherein the universal visual shield forms a substantially crescent-shaped outline in an operational configuration thereof, and the crescent shaped outline includes a central wide portion and two narrow ends.

19. The hockey helmet kit of claim 15, wherein the shield apparatus extends outwardly from an area of the helmet beneath the nose of the user to partially block the field of downward vision of the user.

20. The hockey helmet kit of claim 15, wherein the panel member of the main shield body comprises a flexible material for minimizing harm to the user or to another player if the user becomes involved in a collision while wearing the apparatus.

* * * * *